US005996320A

United States Patent [19]

Todd et al.

[11] Patent Number: 5,996,320

[45] Date of Patent: Dec. 7, 1999

[54] AUTOMATED BAGGING APPARATUS AND METHOD

[75] Inventors: William H. Todd, Winston-Salem; Joseph L. Collins, Jr., Clemmons; Thomas A. Reavis, King, all of N.C.

[73] Assignee: Todd Motion Controls, Inc., Winston Salem, N.C.

[21] Appl. No.: 09/042,677

[22] Filed: Mar. 13, 1998

[51] Int. Cl.[6] ..... B65B 61/24; B65B 43/14; B65B 7/06

[52] U.S. Cl. ..... 53/526; 53/572; 53/258; 53/284.7; 53/373.4; 53/373.6

[58] Field of Search ..... 53/572, 571, 570, 53/258, 260, 284.7, 529, 526, 373.4, 373.6

[56] References Cited

U.S. PATENT DOCUMENTS

| | | | |
|---|---|---|---|
| 3,469,364 | 9/1969 | Bischoff | 53/373.4 X |
| 3,766,710 | 10/1973 | Goodwin et al. | 53/373.6 |
| 3,886,713 | 6/1975 | Mitchell et al. | 53/373.4 X |
| 4,018,031 | 4/1977 | Smaw | 53/572 X |
| 4,292,786 | 10/1981 | Long et al. | 53/526 X |
| 4,391,081 | 7/1983 | Kovacs | 53/526 X |
| 4,751,808 | 6/1988 | Hadden | 53/373.4 X |
| 5,042,227 | 8/1991 | Merry | 53/438 |
| 5,172,629 | 12/1992 | Merry | 100/35 |
| 5,309,828 | 5/1994 | Merry | 100/35 |
| 5,417,912 | 5/1995 | Merry | 264/320 |
| 5,682,734 | 11/1997 | Laster | 53/572 |
| 5,706,987 | 1/1998 | Todd et al. | 223/76 |

*Primary Examiner*—Linda Johnson

[57] ABSTRACT

An automated bagging apparatus for use in the hosiery industry which tightens the bag around the hosiery articles prior to sealing to eliminate any extra bag space. This tightening effect is accomplished by holding the articles in place while extending the bag from the articles. The bag, while extended is sealed and trimmed prior to moving the sealed bag onto a conveyor belt for further handling.

13 Claims, 8 Drawing Sheets

AUTOMATED BAGGING APPARATUS AND METHOD

BACKGROUND OF THE INVENTION

1. Field of the Invention

The invention herein pertains to an automated bagging apparatus suitable for use in the hosiery industry, and particularly to an improved bagging apparatus which eliminates excess space in the bag prior to sealing.

2. Description of the Prior Art And Objectives of the Invention

Automated bagging devices are common in the hosiery industry, and typically perform the functions of: placing hosiery in a plastic bag; moving the filled bag to a heat sealer; sealing the bag by fusing the plastic lips of the bag together and sending the sealed bag to a further point along the assembly line. These machines often have a common failing in that they routinely mis-seal the bags, by leaving too much space in the bags after sealing. In bags where there is too much space, the hosiery contained therein sags when vertically displayed such as in a retail store. Marketing dictates that no more than approximately one quarter inch (0.635 cm) of space exist between the top seal of the bag and the top of the hosiery contained therein to prevent excess sagging. Likewise, if this tight tolerance is not met, there can be much wasted space in the shipping cartons used to ship the hosiery from the factory to its ultimate retail store.

When there is not excess space in the bag after sealing by prior art machines, frequently too little spacing causes the bagging machine to seal the bag with the hosiery caught along the seal line. This results damages to the package and in unsalability of hosiery as the melted plastic bag adheres to the hosiery.

Thus, with the problems associated with the prior bagging machines, it is an object of the present invention to provide an automated bagging apparatus which eliminates excess space in a sealed bag while preventing the bag from inadvertently sealing atop the hosiery.

It is another object to sufficiently compress the hosiery within the bag.

It is a further object of the present invention to provide a bagging apparatus for incorporation in automated hosiery production lines.

It is another object of the present invention to provide a device which uses pneumatic power as is commonly used on hosiery assembly lines.

It is still a further object to provide a bagging apparatus wherein the sealing and trimming of the bag occurs contemporaneously for efficiency purposes.

It is yet another object to provide a bagging apparatus which can be adjusted to seal the bags for any number of desired hosiery or bag sizes.

It is a further object to provide a bagging apparatus which corrects a misaligned stack of hosiery after bagging.

It is still a further object to provide a method of bagging socks which eliminates excess space in the bag prior to sealing.

Still further objects and advantages of the invention will become readily apparent to those skilled in the art to which the invention pertains upon reference to the following detailed description.

SUMMARY OF THE INVENTION

This invention provides an automated bagging apparatus for use in the hosiery industry. Specifically, it provides an improved apparatus which inserts hosiery into a bag, moves the bag to a clamp, clamps the bag, eliminates excess space in the bag by holding the hosiery while drawing the bag taunt and compressing the hosiery within the bag. The bag is then heat sealed and the extra bagging material is trimmed. The hosiery substantially fills the bag. The bagged hosiery is then pushed onto a conveyor belt for subsequent packing and shipping. The method of bagging closely follows the function of the apparatus.

DETAILED DESCRIPTION OF THE PREFERRED EMBODIMENT AND OPERATION OF THE INVENTION

Figure 1:
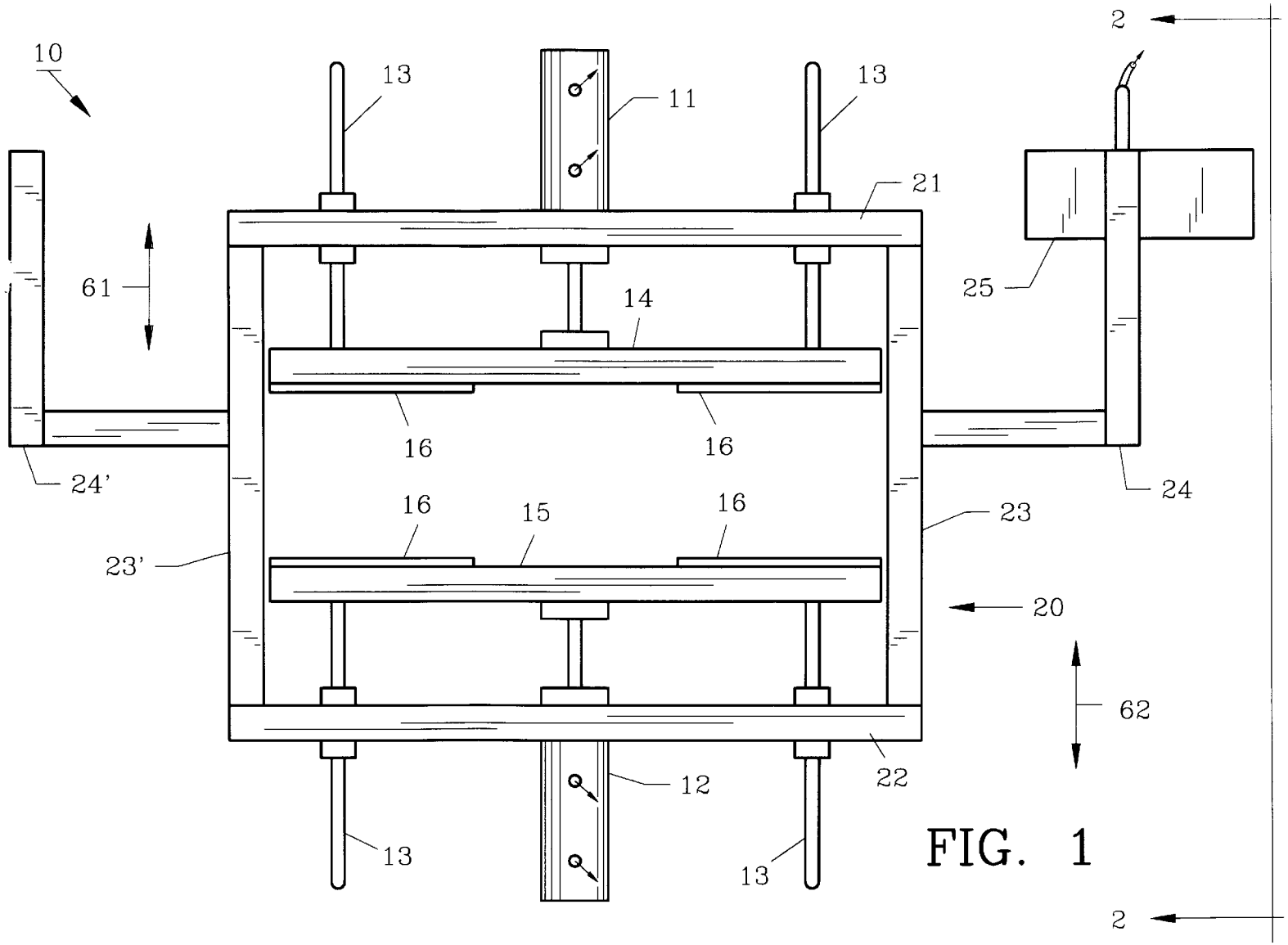
FIG. 1 shows a front elevational view of the clamp assembly of the present invention removed from the complete bagging apparatus.

Turning now to the drawings, FIG. 1 shows preferred clamp assembly 10 removed from preferred bagging apparatus 30. Clamp assembly 10, preferably made out of a metal such as aluminum or stainless steel, with frame 20 comprised of top 21, bottom 22 and sides 23 and 23'. Sides 23 and 23' have arms 24 and 24' respectively which attach to frame 40 of bagging apparatus 30 (not seen in FIG. 1). Clamp assembly 10 includes top pneumatic cylinder 11 and bottom pneumatic cylinder 12 which control top piece 14 and bottom piece 15 respectively. Disposed on the interior portions of top and bottom clamp pieces 14 and 15 are rubber grip pads 16. Guide rods 13 assist in moving top and bottom clamp pieces 14 and 15 in a vertical direction generally indicated by arrows 61 and 62 (FIG. 1) respectively. Side plate 25 is mounted on side arm 24.

Figure 2:
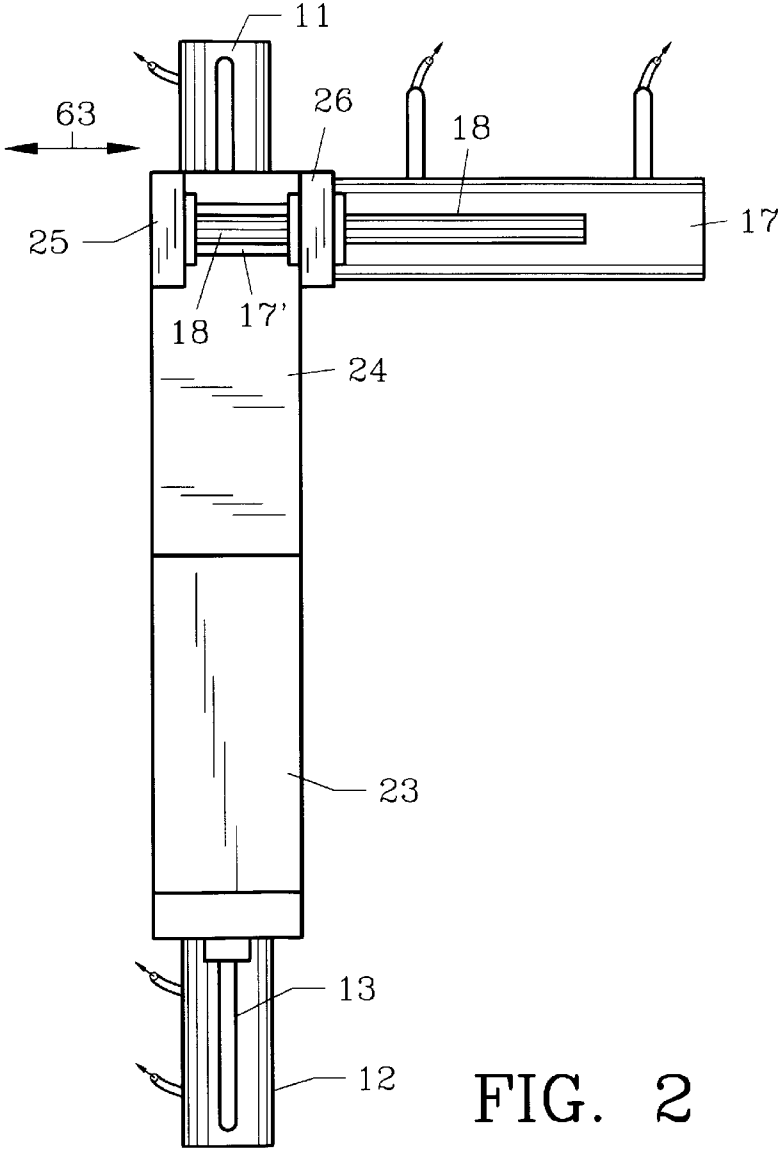
FIG. 2 illustrates a side elevational view of the clamp along line 2—2 of FIG. 1.
Figure 7:
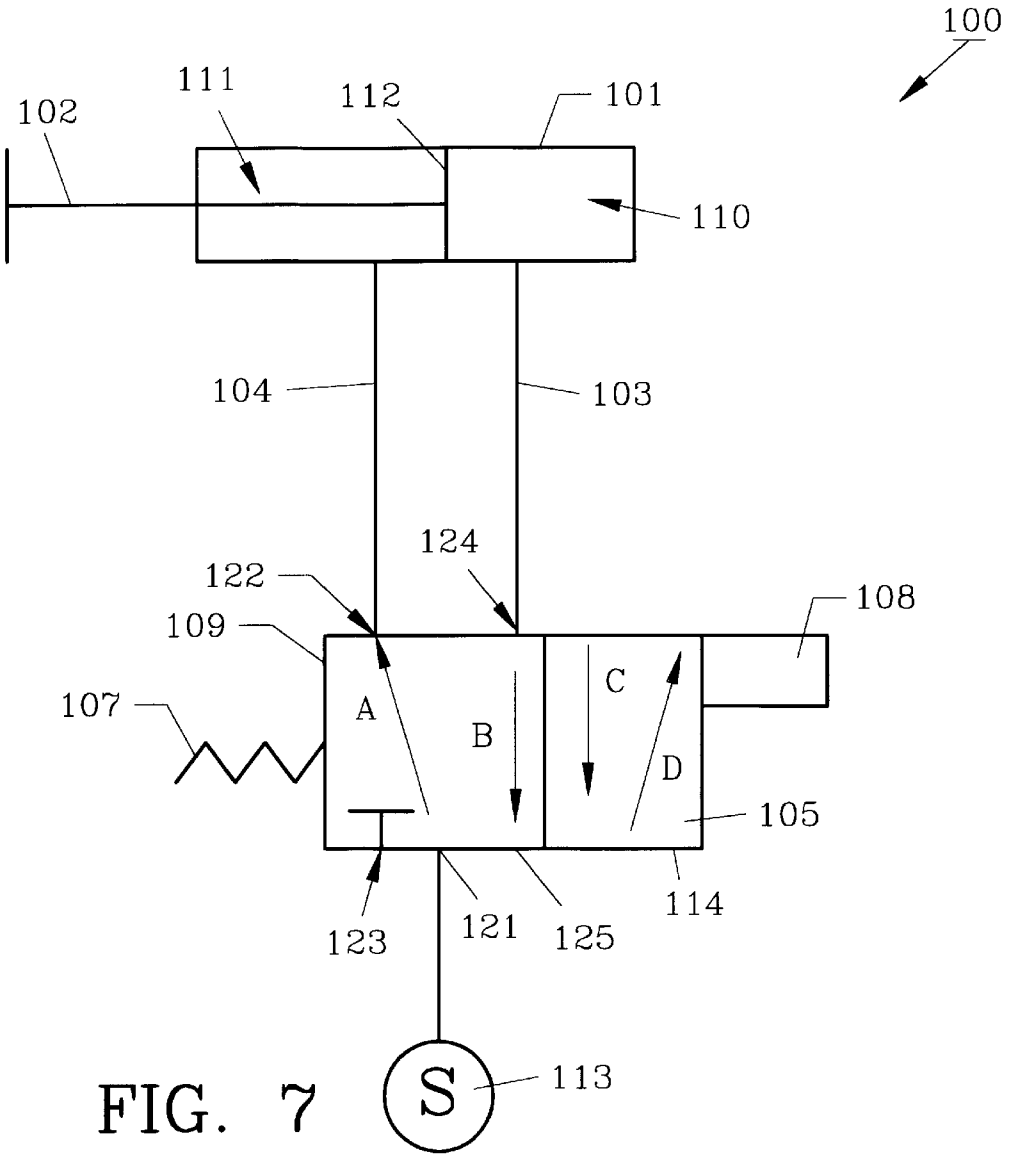
FIG. 7 illustrates an example of a conventional pneumatic layout as used with the invention.

In FIG. 2, pneumatic cylinder 17 can be seen attached to frame plate 26 while piston rod 17' and a pair of guiding rods 18 (only one shown, the other disposed behind piston rod 17') pass through frame plate 26 and attach to side plate 25. In operation, pneumatic cylinder horizontally drives side plate 25 as generally indicated by arrow 63. Frame plate 26 attaches pneumatic cylinder 17 to frame 40 of preferred bagging apparatus 30. Pneumatic cylinder 17 moves side plate 25, which in turn moves entire clamp assembly 10 horizontally. Pneumatic cylinder 17 has a conventional stop collar (not shown) which permits adjustment of the horizontal movement of clamp assembly 10. I.e. adjusting the location of the stop collar controls the extension of piston rod 17' of cylinder 17. It should be understood that pneumatic cylinders recited herein are conventional and perform substantially as indicated in the schematic view and description of FIG. 7.

Pneumatic circuit 100 consists of pneumatic cylinder 101 with chambers 110 and 111 separated by end 112 of piston rod 102. Air lines 103 and 104 supply chambers 110 and 111 respectively from control box 105. Control box 105 has five (5) openings 121–125, default valves 109, secondary valves 114, spring 107 and electrical control 108. Spring 107 biases control box 105 so that primary valves 109 align with openings 121–125 and operate as follows: opening 121 connects to source 113 such as a compressor which supplies air through opening 121 along arrow A to opening 122 and through line 104 to chamber 111. This air flow urges end piece 112 such that piston rod 102 retracts. Any air in chamber 110 is then forced through line 103 and out opening 124 along arrow B and out opening 125 which is vented to the outside. Upon receiving a signal in electrical control 108, secondary valves 114 slide into position thereby compressing spring 107 and forming a new series of connections. Specifically, source 113 now directs air through opening 121 along arrow D, out opening 124 along line 103 to chamber 110. This urges end 112 outwardly, thereby extending piston rod 102. Any air in chamber 111 is then forced along line 104 into opening 122, along arrow C and out opening 123 which is vented to the outside. Each pneumatic cylinder functions substantially identically and in parallel, with the appropriate conventional pneumatic line connections as would be understood. In this manner, a stop collar (not shown) limits the movement of end 112 and thereby restricts the movement of piston rod 102, which is conventional. Guide rods, such as those shown in FIGS. 1 and 2, assist in maintaining proper alignment of piston rod 102, and are conventional and used as required herein.

PREFERRED METHOD AND STRUCTURE

Figure 3:
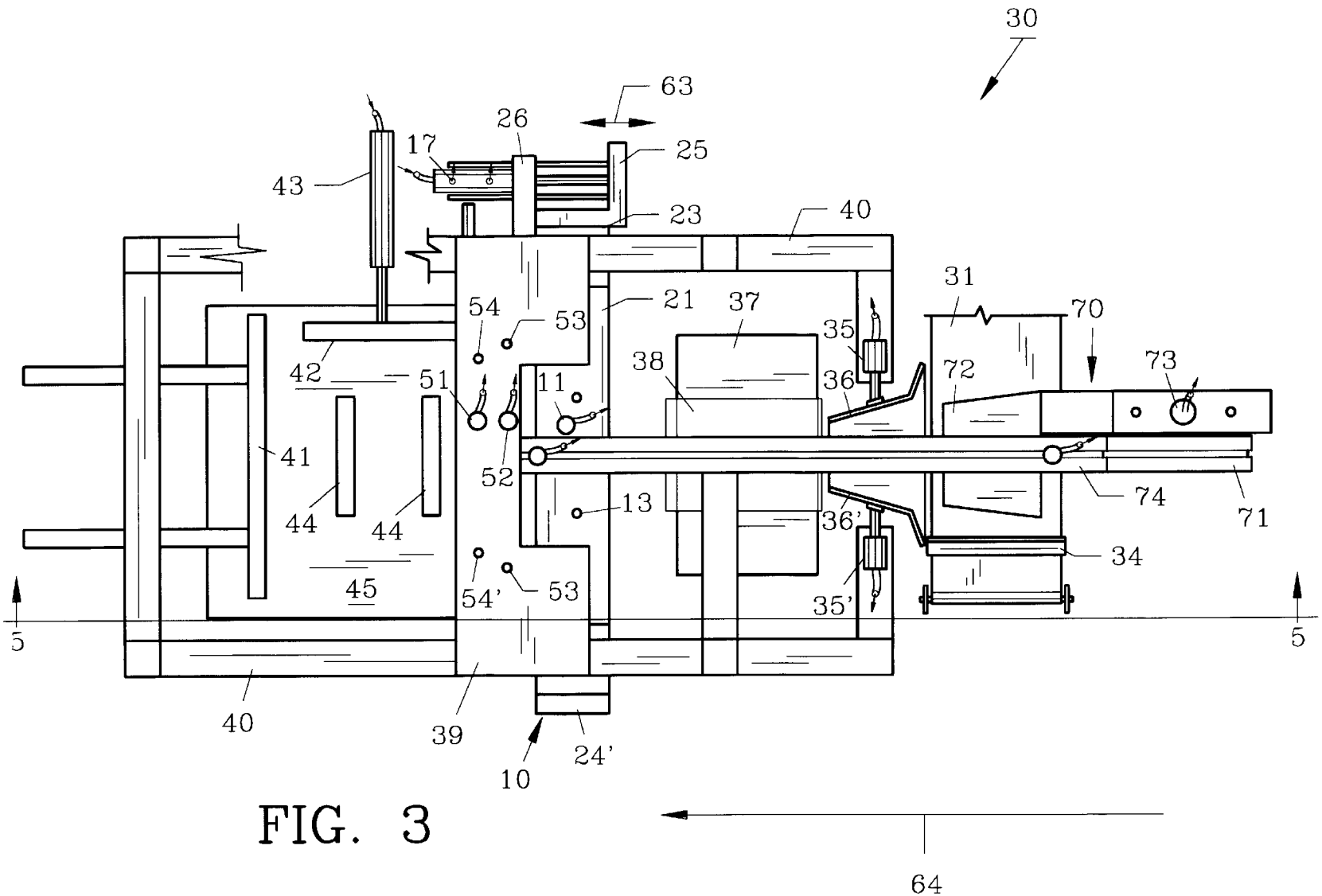
FIG. 3 demonstrates a top view of the bagging apparatus of the present invention.
Figure 4:
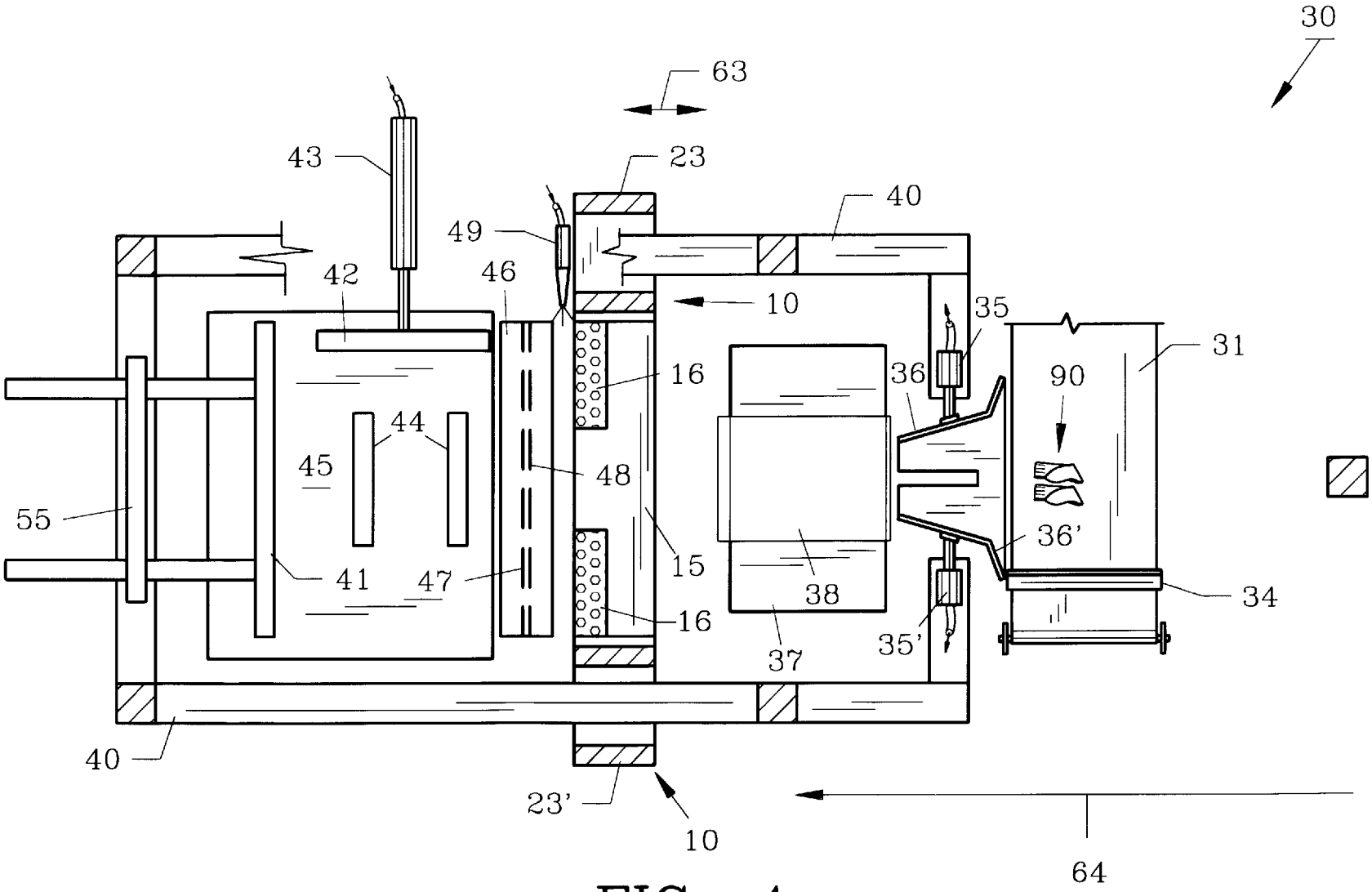
FIG. 4 features a view of the bagging apparatus along line 4—4 of FIG. 5.
Figure 5:
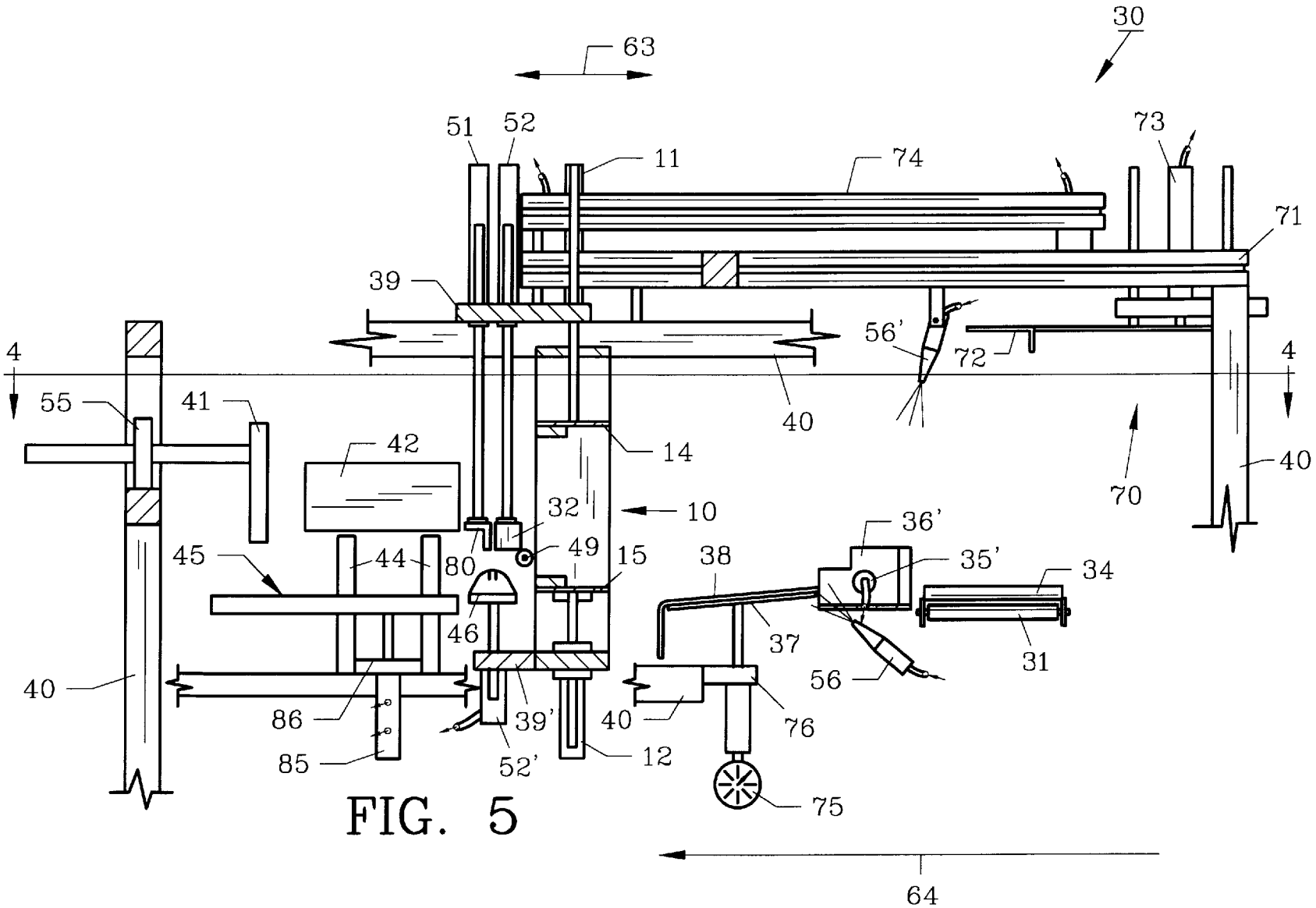
FIG. 5 pictures a side view of the bagging apparatus along line 5—5 of FIG. 3.

Turning now to FIGS. 3 and 5, clamp assembly 10 is shown mounted in bagging apparatus 30, specifically attached to a track (not shown) mounted on frame 40. As is conventional, sock stack 90 (FIG. 4) travels along conveyor 31 and stops on stop plate 34 until a desired or selected number of sock stacks 90 are present. At a predetermined cycle time, sock moving assembly 70 begins to operate. Specifically, pneumatic cylinder 73 lowers moving plate 72 to compress sock stack 90. As moving plate 72 is lowered, bag 38 resting on bag support plate 37 is inflated by air from nozzles 56 and 56' (FIG. 5). After inflation, bag opening arms 36 and 36' are retracted by bag opening pneumatic cylinders 35 and 35' respectively, and hold bag 38 open for the reception of sock stacks 90 therein.

After inflation of bag 38, bag opening arms 36 and 36' are moved to hold bag 38 open, sock moving plate 72 is driven by pneumatic pipe 74 along track 71 in a horizontal, longitudinal (as defined herein) manner generally indicated by arrow 64. Moving plate 72 inserts sock stack 90 into bag 38 and transports bag 38 with sock stack 90 to supports 44. Supports 44 extend through apertures (not shown) in surface 45. Surface 45 is attached to pneumatic cylinder 85. Cylinder 85 is mounted on frame 40 by plate 86 (FIG. 5). Thus, surface 45 can be raised and lowered as desired. Back plate 41 attached to frame 40 by brace 55 (FIGS. 4 and 5) prevents filled bag 38 from traveling too far. Moving plate 72 is then longitudinally retracted to its original position.

Bag 38 now rests on supports 44 and its open or non sealed end, which received sock stacks 90, extends through clamp assembly 10 while resting in part across sealing unit 46 and across bottom clamp plate 15. Clamp assembly 10 closes on bag 38 while stop plate 80 is lowered by pneumatic cylinder 51. Cylinder 51 is mounted on frame 40 by plate 39. Horizontal member 81 of stop plate 80 holds sock stack 90 in place. Vertical member 82 (FIG. 6A) holds sock stacks 90 in place and properly aligns misaligned stacks. Clamp assembly 10 moves longitudinally towards conveyor 31 as generally indicated by arrow 63 thereby compressing sock stacks 90 within bag 38 as sock stacks 90 push against vertical member 82 of stop plate 80. Sealing unit 46 with heating element 47 and cutting element 48 (seen better in FIG. 4) are raised by pneumatic cylinder 52'. Cylinder 52' is mounted on frame 40 by plate 39' while reflector unit 32 is lowered by pneumatic cylinder 52. Cylinder 52 is mounted on frame 40 by plate 39. Sealing unit 46 then seals bag 38 as is conventional while cutting element 47 trims off any excess portion of bag 38. Air nozzle 49 (FIGS. 4 and 5) blows the trimmed excess portion of bag 38 into a suitable receptacle (not shown) thereby leaving bag 38 sealed for future handling.

Bag support plate 37 is attached to pressure sensing device 75 mounted on frame 40 by plate 76. Pressure sensing device 75 can be used to alert the operators when the bag supply is low. Sealing unit 46 contains conventional compressive resistive heating element 47 which has a width sufficient to give a desired seal, and also includes cutting element 48. Likewise, conventional tracks and guides are used to move clamp assembly 10 laterally towards conveyor 31 and moving plate 72 back and forth along track 71.

In FIGS. 3 and 4, plate 42 is attached to pneumatic cylinder 43 and is designed to push the sealed bag laterally from supports 44 and preferably onto another conveyor (not shown) for further packaging and shipping.

Figure 6B:
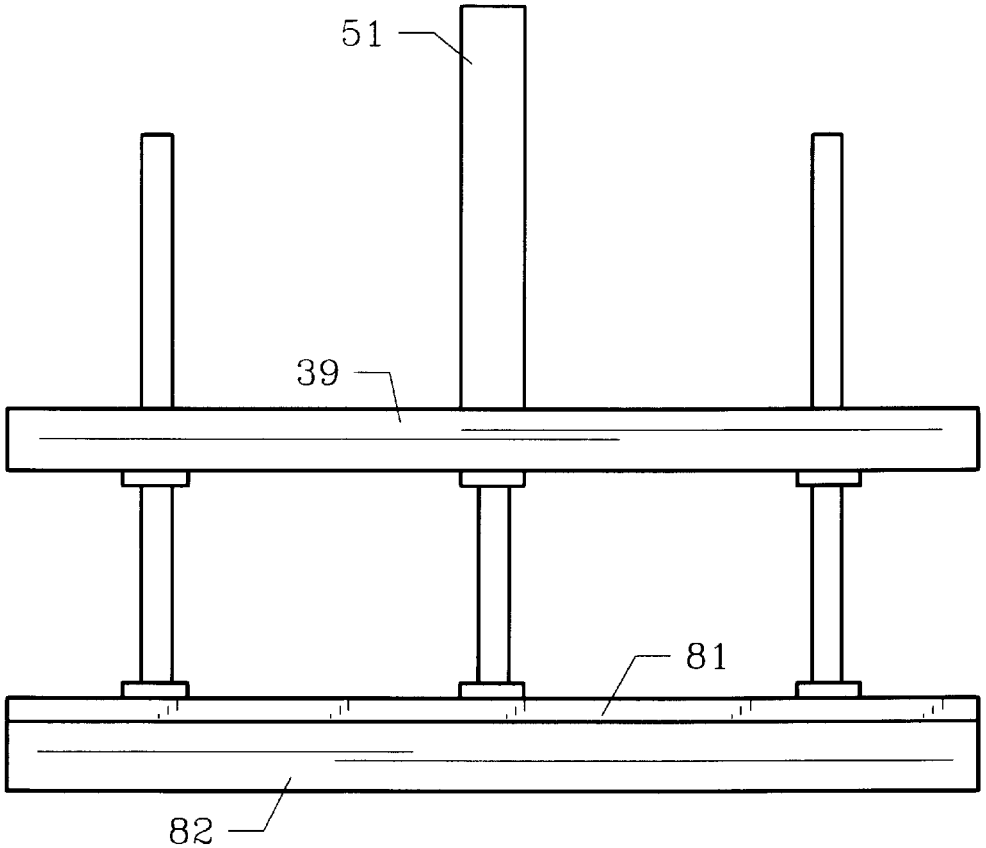
FIG. 6B shows a front view of the compressing mechanism of the invention.
Figure 6A:
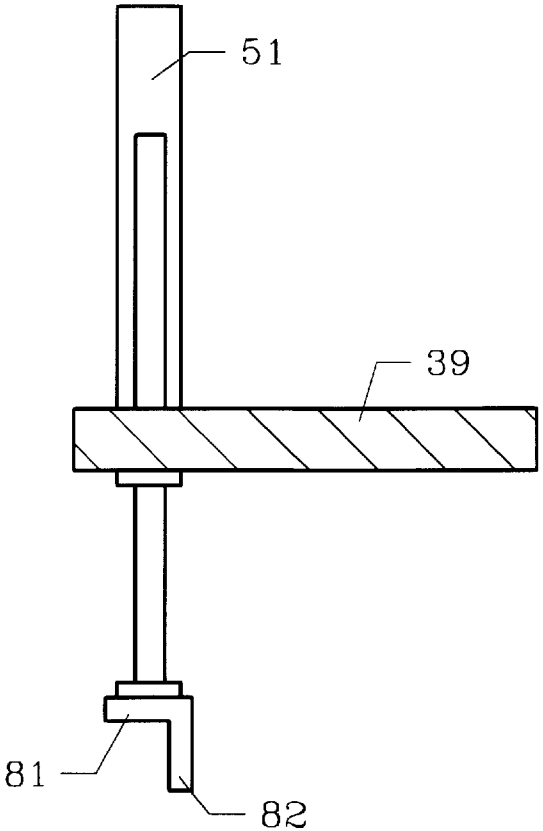
FIG. 6A depicts an enlarged side view of the compressing mechanism of the present invention.

FIGS. 6A and 6B show an enlarged view of stop plate 80 and its pneumatic cylinder 51 positioned on plate 39 which is in turn mounted on frame 40. Stop plate 80 has horizontal member 81 which compresses sock stacks 90 vertically within bag 38 against supports 44. At the same time, vertical member 82 compresses sock stacks 90 horizontally as clamp assembly 10 draws bag 38 towards conveyor 31.

Figure 8:
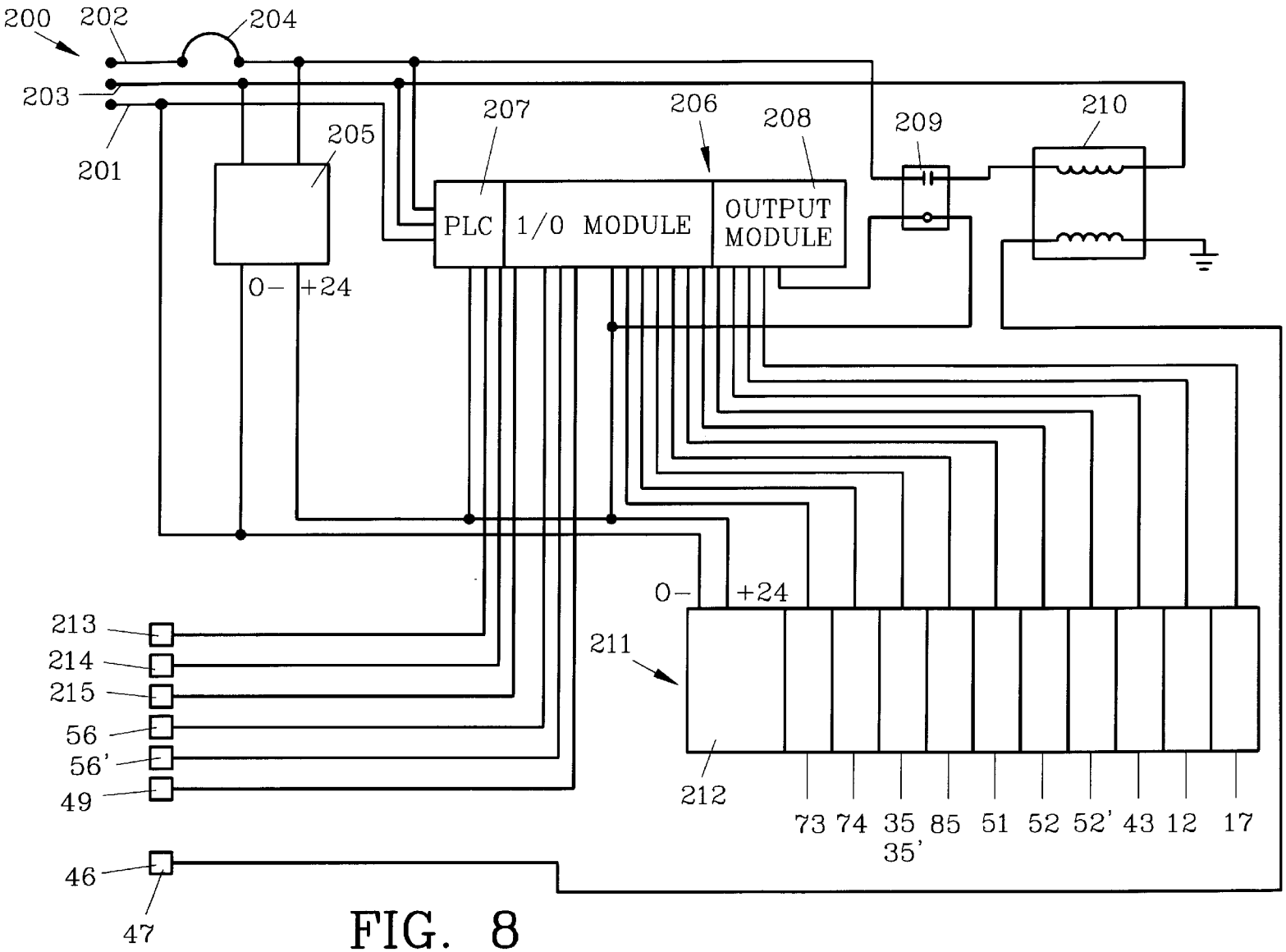
FIG. 8 demonstrates an electrical schematic of the bagging apparatus of the invention.

FIG. 8 is an electrical schematic for sock bagging apparatus 30. Specifically conventional alternating electrical power is introduced at point 200 through ground wire 201, hot wire 202 and neutral wire 203. Circuit breaker interrupt 204 is positioned on hot wire 202 as is conventional. Power supply 205 converts alternating current to 24 V direct current for control module 206. Control module 206 comprises a PLC Direct brand Programmable Logic Controller (base model number D204B) as manufactured by Koyo which includes a central processing unit (not shown, but 230, 240 or 250 is acceptable) input module 207 (model number D2-16ND3-2) and output module 208 (model number D2-16TD1-2 all sold by PLC Direct of 3505 Hutchinson Road, Cummings, Ga. 30040). Solid state relay 209 receives alternating current and direct current and is connected electrically to output module 208 and transformer 210, which is a 10:1 step-down transformer. Power supply 205 provides power to electrical termination module 212 for valve bank 211. Valve bank 211 includes pneumatic tubes 12, 17, 35, 35', 43, 51, 52, 52', 73, 74 and 85 as shown. Additionally connected to input module 207 are bagger start photoeye 213 which initiates the bagging process; bag dropped photoeye 214 which is a diagnostic switch for indicating malfunctions; and low air pressure switch 215 for indicating insufficient air pressure for proper bagger operation. Conventional pneumatic nozzles 49, 56, and 56' are also controlled by input module 207. Sealing unit 46 and cutting element 47 are energized by the output of transformer 210 as is well understood.

The preceding recitation is for illustrative purposes only and is not intended to limit the scope of the appended claims.

What is claimed is:

1. Apparatus for automated packaging of articles in a bag, said apparatus comprising:

a) a frame;

b) means for inserting articles in the bag, said insertion means mounted on said frame;

c) a movable clamp, said clamp mounted proximate said frame, said clamp opening and closing and movable within said frame; and d) means for sealing the bag, said bag sealing means mounted proximate said frame.

2. The apparatus as claimed in claim 1 further comprising means for moving said clamp, said clamp moving means mounted proximate said clamp.

3. The apparatus as claimed in claim 1 further comprising means for holding the bagged article in place while said clamp is moved to extend the bag, said holding means mounted proximate said frame.

4. The apparatus as claimed in claim 1 further comprising means for cutting said bag, said bag cutting means mounted proximate said frame.

5. The apparatus as claimed in claim 1 further comprising means to inflate the bag, said bag inflating means mounted proximate said frame.

6. The apparatus as claimed in claim 2 wherein said means for moving said clamp comprises a pneumatic cylinder.

7. The apparatus as claimed in claim 3 wherein said means for holding the article in place comprises a stop plate.

8. The apparatus as claimed in claim 1 wherein said sealing means comprises a resistive heating element.

9. The bagging apparatus as claimed in claim 1 further comprising means to move the bag into said clamp, said bag moving means mounted proximate said frame.

10. Apparatus for automated packaging of articles in a bag, said apparatus comprising:

a) means for inserting articles in the bag;

b) a clamp, said clamp proximate said insertion means, said clamp moveable between open and closed positions, said clamp movable so as to compress the articles within the bag; and c) means for sealing the bag, said bag sealing means proximate said clamp.

11. The apparatus as claimed in claim 10 wherein the bag sealing means comprises a resistive heating element.

12. The apparatus as claimed in claim 10 further comprising means for inflating the bag prior to insertion of the articles, said bag inflating means proximate said insertion means.

13. The apparatus as claimed in claim 10 further comprising means for moving the bag from said insertion means to said clamp, said bag moving means connecting said insertion means to said clamp.

* * * * *